US006677849B1

(12) United States Patent
Kato et al.

(10) Patent No.: US 6,677,849 B1
(45) Date of Patent: Jan. 13, 2004

(54) HIGH-VOLTAGE VARIABLE RESISTOR

(75) Inventors: Shinji Kato, Mishima-gun (JP); Yoshihiro Sako, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/283,302

(22) Filed: Oct. 30, 2002

(30) Foreign Application Priority Data

Oct. 30, 2001 (JP) ..... 2001-333081
Jan. 25, 2002 (JP) ..... 2002-017481
Sep. 27, 2002 (JP) ..... 2002-283542

(51) Int. Cl.[7] ..... H01C 10/30
(52) U.S. Cl. ..... 338/162; 338/160; 338/184
(58) Field of Search ..... 338/160, 162, 338/184

(56) References Cited

U.S. PATENT DOCUMENTS 2,866,876 A * 12/1958 Cohen ..... 338/174
5,912,613 A * 6/1999 Kotani et al. ..... 338/160
5,986,537 A * 11/1999 Kato ..... 338/68
6,100,786 A * 8/2000 Ryu ..... 338/128
6,140,908 A * 10/2000 Choi ..... 338/162
6,200,156 B1 * 3/2001 Hiraki et al. ..... 439/395

FOREIGN PATENT DOCUMENTS

JP 6-2610 1/1994
JP 10-074605 3/1998

* cited by examiner

*Primary Examiner*—Karl D. Easthom
(74) *Attorney, Agent, or Firm*—Keating & Bennett, LLP

(57) ABSTRACT

A high-voltage variable resistor includes a high-voltage variable-resistor substrate, which has at least a base, having at least a resistor element and at least one land electrode on the front surface thereof, and a plurality of through-holes formed at the land electrode so as to electrically connect the front and rear surfaces of the base.

19 Claims, 13 Drawing Sheets

HIGH-VOLTAGE VARIABLE RESISTOR

BACKGROUND OF THE INVENTION

1. Field of the Invention

The present invention relates to a high-voltage variable resistor for regulating a focus voltage or a screen voltage of a TV receiver or other suitable device.

2. Description of the Related Art

A known high-voltage variable resistor for regulating a focus voltage or a screen voltage of a TV receiver is disclosed, for example, on pages 5 and 6 and in FIG. 1 of Japanese Unexamined Utility Model Registration Application Publication No. 6-2610. Such a high-voltage variable resistor includes a high-voltage variable-resistor substrate having a resistor element and land electrodes provided thereon. The front and rear sides of the base of the high-voltage variable-resistor substrate are electrically connected via through-holes provided at corresponding land electrodes, although this method is not specifically disclosed.

Referring now to FIG. 6, an undisclosed high-voltage variable-resistor substrate will be described. FIG. 6 is a plan view of a known high-voltage variable-resistor substrate 51.

The high-voltage variable-resistor substrate 51 includes a base 52 having a resistor element 61 and two land electrodes 62 and 63 on the front side thereof. The two land electrodes 62 and 63 include through-holes 64 and 65, respectively, in which a conductive paste or other suitable material is filled so as to electrically connect the front and rear sides of the base 52 of the high-voltage variable-resistor substrate 51. However, in the high-voltage variable-resistor substrate 51 used in the above-described known high-voltage variable resistor, the through-holes 64 and 65 are often insufficiently filled with the conductive paste or other suitable material depending upon the variations in printing conditions of the land electrodes, causing faulty electrical continuity between the front and rear sides of the base 52 of the high-voltage variable-resistor substrate 51, and accordingly, reducing the reliability of the high-voltage variable resistor.

Also, another known high-voltage variable resistor having an insulating case formed by fitting first and second insulating cases together is disclosed, for example, in Japanese Patent Application Publication No. 10-74605. The disclosed high-voltage variable resistor includes the insulating case, an insulating substrate provided in the insulating case and having a variable-resistor circuit pattern on the front surface thereof, and a slider arranged between the front surface of the insulating substrate and the insulating case.

The first and second insulating cases of the known high-voltage variable resistor are engaged with each other in the following manner. As shown in FIG. 7A, a front case 100*a* defining the first insulating case includes a side wall 122 at each peripheral side thereof. The side wall 122 includes two flat plate members 121 and a fitting depression 120 provided between the two flat plate members 121. The side wall 122 also includes an engaging hole 140 provided therein. One end of the engaging hole 140 is open at the inner wall of the fitting depression 120 and the other end is open at the outer wall of the front case 100*a*.

Also, as shown in FIG. 7B, a rear case 100*b* defining the second insulating case includes a side wall 110 defined by a single flat plate member at each peripheral side thereof. The front of the side wall 110 is fitted into the fitting depression 120 of the front case 100*a*. In addition, the side walls 110 include an opening end 111 in which an engaging projection 130 is provided, and the engaging projection 130 elastically engages the engaging hole 140. More specifically, as shown in FIG. 7C, since the engaging projection 130 and the engaging hole 140 elastically engage each other, the front case 100*a* and the rear case 100*b* are attached together, thereby allowing the insulating case 100 to be formed without using a welding technique. Although only one side wall of the insulating case is illustrated in FIGS. 7A to 7C, the other three side walls are formed in substantially the same manner as described above.

The insulating substrate provided in the insulating case 100 includes a slit at each corner thereof, formed by cutting the insulating substrate from the peripheral side surface towards an inner portion thereof. The slits include elastic conductors, such as coil springs or conductive rubbers, fitted therein so as to sandwich the insulating substrate. The conductors are electrically connected to an input-terminal electrode and a ground terminal electrode provided on the front surface of the insulating substrate. Also, the conductors are electrically connected to input terminals and ground terminals inserted from the rear surface of the insulating substrate of the insulating case. As described above, the conductors define electrical conducting members between the input terminals and the ground terminals and the input-terminal and ground-terminal electrodes, respectively. In addition, when the insulating case is formed by fitting, the conductors are pressed by the inner bottom surfaces of the front and rear cases 100*a* and 100*b* such that the insulating substrate is sandwiched and held by this pressing force in the depth direction thereof.

However, in the known high-voltage variable resistor, since the engaging projection 130 of the rear case 100*b* is provided in the opening end 111 of the side walls 110, and also one end of the engaging hole 140 of the front case 100*a* is open at the inner wall of the fitting depression 120 and the other end is open at the outer wall of the front case 100*a*, the insulating case 100 has a gap 150, in communication with the inside thereof, provided at the engaging portion between the engaging projection 130 and the engaging hole 140. Accordingly, there is a risk that dust, moisture, or other impurities will intrude into the inside of the insulating case 100 of the variable resistor through the gap 150, and a poor connection or deteriorated characteristics may occur. Also, the gap 150 greatly reduces the dielectric strength of the variable resistor.

In addition, the known high-voltage variable resistor has a problem in that not only does fitting the conductors in the slits provided in the insulating substrate require an additional manufacturing step, but also the slits reduce the durability of the insulating substrate and increase the defective ratio of products through breakage.

SUMMARY OF THE INVENTION

In order to overcome the above-described problems, preferred embodiments of the present invention provide a high-voltage variable resistor including front and rear cases defining an insulating case that are reliably brought into close contact and engaged with each other without producing a gap at any engaging portions in the side walls of the front and rear cases, an insulating substrate is fixed in the insulating case without forming a slit therein, and also input terminals and ground terminals are electrically connected with corresponding terminal electrodes on the front surface of the insulating substrate.

A high-voltage variable resistor according to preferred embodiments of the present invention includes an insulating case, having first and second insulating cases, and a high-voltage variable-resistor substrate. The high-voltage variable-resistor substrate includes a base having a resistor element on the front surface thereof, a plurality of through-hole electrodes arranged so as to extend through the base, and at least one land electrode provided on each of the front and rear surfaces of the base and connected to the through-hole electrodes. The plurality of the through-hole electrodes is provided at the land electrode of the high-voltage variable-resistor substrate, the high-voltage variable-resistor substrate is housed in the insulating case, at least one conductor is disposed in the second insulating case, and the conductor and the land electrode on the rear surface of the high-voltage variable-resistor substrate are electrically connected to each other.

In the high-voltage variable resistor according to preferred embodiments of the present invention, the plurality of through-hole electrodes are arranged around the at least one land electrode along an approximate circle.

In the high-voltage variable resistor according to preferred embodiments of the present invention, each portion of the land electrode surrounding a corresponding one of the plurality of through-hole electrodes, preferably has substantially the same shape.

With this arrangement, since each land electrode includes the plurality of through-hole electrodes provided thereat, even when one of the through-hole electrodes has faulty electrical continuity, the front and rear surfaces of the base of the high-voltage variable-resistor substrate are electrically connected with each other via the other through-hole electrodes, thereby greatly reducing the defective ratio and greatly increasing the reliability of the high-voltage variable resistor.

Also, since the plurality of through-holes are arranged along an approximate circle, stresses in the base produced when the through-holes are formed by punching are evenly decentralized, thereby greatly reducing the probability of breakage of the base, and thus, greatly increasing the reliability of the high-voltage variable resistor.

In addition, since portions of the plurality of land electrodes have substantially the same shape, when the through-holes are to be filled with a conductor such as a conductive paste, the conductor is more evenly filled in all the through-holes, thereby reducing the required amount of filling conductor, and thus, increasing the productivity of the high-voltage variable resistors.

The high-voltage variable resistor according to preferred embodiments of the present invention preferably further include at least one rotating shaft including a slider which slides on the resistor element. The first insulating case includes a plate-like portion, side walls provided along the peripheral sides of the plate-like portion, at least one bearing which is disposed in the plate-like portion and which rotatably supports the rotating shaft, an opening end defined by the side walls, and at least one first engaging member arranged at a predetermined location of the side walls. Also, the second insulating case includes a plate-like portion, side walls disposed along the peripheral sides of the plate-like portion, an opening end defined by the side walls, and at least one second engaging member arranged at a predetermined location of the side walls. In addition, by engaging the first engaging member of the side walls of the first insulating case with the second engaging member of the side walls of the second insulating case, the high-voltage variable-resistor substrate is housed in the insulating case, and the first insulating case and the second insulating case are engaged with each other so as not to produce a gap therebetween which extends to the inside of the insulating case.

More particularly, in the high-voltage variable resistor according to preferred embodiments of the present invention, the engaging member disposed at the predetermined places of the side walls of the first and second insulating cases are preferably provided at the location other than the opening ends. For example, one of the engaging members disposed at the predetermined locations of the side walls of the first and second insulating cases is an engaging projection, and the other is one of an engaging groove, an engaging depression, and an engaging step.

In the high-voltage variable resistor according to preferred embodiments of the present invention, either of each side wall of the first insulating case and each side wall of the second insulating case preferably includes at least one flat plate member, and the other preferably includes a plurality of flat plate members and includes at least one depression between the flat plate members. The side wall defined by the at least one flat plate member is inserted into the depression. Also, the engaging members include the engaging projection, disposed at the side wall defined by said at least one flat plate member, and one of the engaging groove, the engaging depression, and the engaging step disposed at the outermost plate member of the side wall defined by the plurality of flat plate members. In addition, the engaging projection is engaged with one of the engaging groove, the engaging depression, and the engaging step.

With the above-described arrangement, since the engaging members are disposed at the predetermined locations of the side walls of the first and second insulating cases, and the first and second insulating cases are engaged with each other so as to prevent a gap in communication with the inside of the insulating case from being produced, the inside of the insulating case is completely covered by the first and the second insulating cases. Accordingly, there is no risk of an undesirable substance intruding into the insulating case, thereby preventing occurrence of a poor connection or characteristic deterioration, and also increasing a dielectric strength since no gap is produced.

In the high-voltage variable resistor according to preferred embodiments of the present invention, either of the side walls of the first and second insulating cases preferably includes depressions on the inner walls thereof, and the high-voltage variable-resistor substrate is preferably held and fixed in the insulating case by inserting the substrate into the depressions. With this structure, the substrate is held and fixed in the insulating case without requiring a slit to be formed in the substrate.

Furthermore, the land electrodes are provided on the rear surface of the high-voltage variable-resistor substrate and are electrically connected to those provided on the front surface of the high-voltage variable-resistor substrate via the through-hole electrodes, at least two elastic conductors are disposed in the plate-like portion of the second insulating case, and the conductors and the land electrodes provided on the rear surface of the high-voltage variable-resistor substrate are brought into press-contact with each other so as to be electrically connected. This structure allows the high-voltage variable-resistor substrate to be clamped by the conductors, the high-voltage variable-resistor substrate to be fixed in the insulating case, and the input and ground terminals inserted into the conductors provided on the rear surface of the high-voltage variable-resistor substrate to be electrically connected to the land electrodes on the front surface of the high-voltage variable-resistor substrate. The conductors are preferably made of a conductive material such as a conductive rubber. With this arrangement, the input and ground terminals are easily inserted into the conductors and the high-voltage variable resistor is easily assembled.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1A:
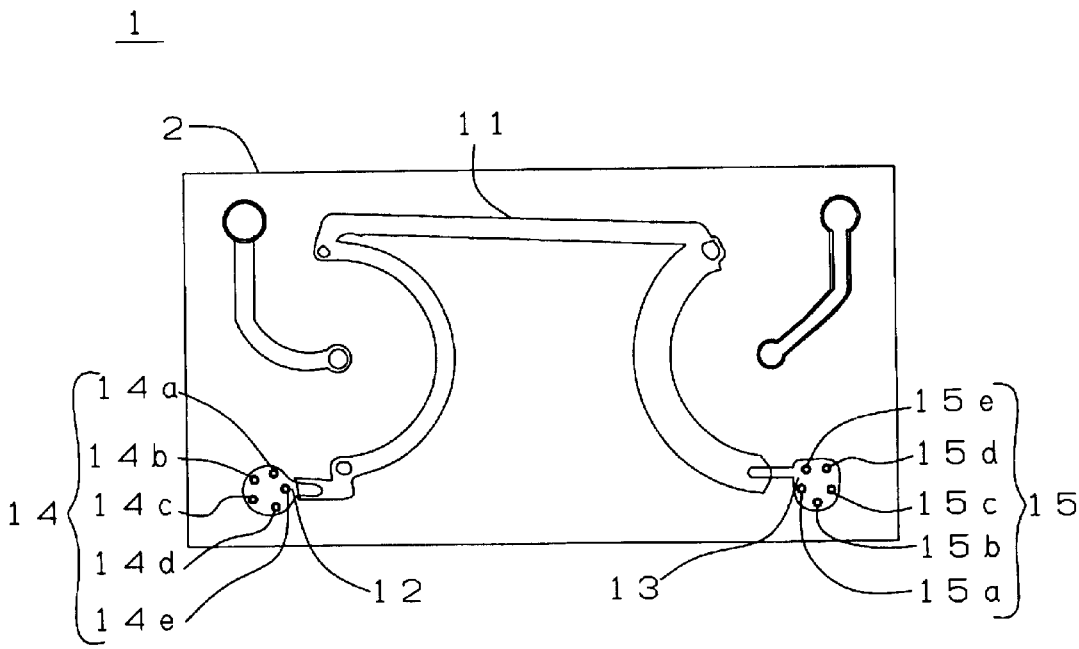
FIGS. 1A and 1B are a plan view and a bottom view, respectively, of a high-voltage variable-resistor substrate, as a first example, used for a high-voltage variable resistor according to a first preferred embodiment of the present invention.
Figure 1B:
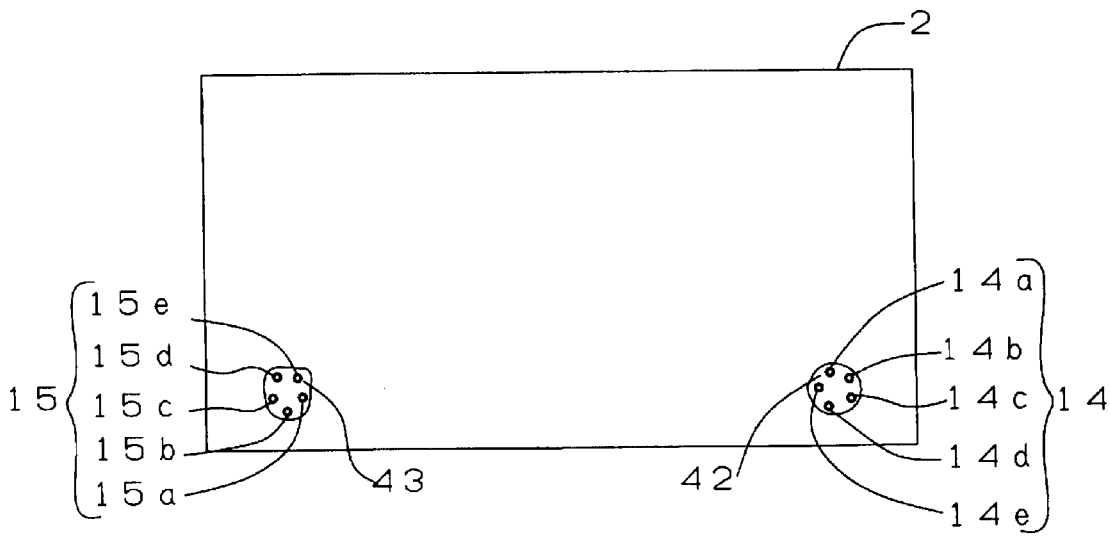

High-voltage variable-resistor substrates used for a high-voltage variable resistor according to a first preferred embodiment of the present invention will be described with reference to FIGS. 1A to 3. FIGS. 1A and 1B are a plan view and a bottom view, respectively, of a high-voltage variable-resistor substrate 1, as a first example, used for a high-voltage variable resistor 30 according to the first preferred embodiment of the present invention.

As shown in FIG. 1A, the high-voltage variable-resistor substrate 1 includes a base 2 which is preferably made of an alumina ceramic and which has a resistor element 11 and two land electrodes 12 and 13 on the front surface thereof. Each of the land electrodes 12 and 13 include a plurality of through-holes 14 (14*a*, 14*b*, 14*c*, 14*d*, 14*e*) and 15 (15*a*, 15*b*, 15*c*, 15*d*, 15*e*), respectively, both extending through the high-voltage variable-resistor substrate 1. The through-holes 14 and 15 are filled with a conductive paste (not shown) so as to serve as through-hole electrodes for electrically connecting the front and rear surfaces of the base 2 of the high-voltage variable-resistor substrate 1.

The through-holes 14 are arranged so as to define a substantially circular configuration as shown in FIG. 1A. A preferable diameter of each through-hole 14 is at least about 0.3 mm from the view point of reliability and the suitable space between the adjacent through-holes 14 is at least the thickness of the base 2.

Also, as with the through-holes 14, a preferable diameter of each through-hole 15 is at least about 0.3 mm and a suitable space between the adjacent through-holes 15 is at least substantially equal to the thickness of the base 2.

As shown in FIG. 1B, the high-voltage variable-resistor substrate 1 includes land electrodes 42 and 43 on the rear surface thereof arranged so as to correspond to the land electrodes 12 and 13, respectively, provided on the front surface thereof. Also, the high-voltage variable-resistor substrate 1 includes the through-hole electrodes defined by the foregoing through-holes 14 and 15 provided on the rear surface thereof so as to electrically connect to the land electrodes 42 and 43, respectively.

Although the alumina ceramic is used for the base 2 in this preferred embodiment, another suitable material may be used.

Also, the conductive paste is used so as to electrically connect the front and rear surfaces of the base 2 of the high-voltage variable-resistor substrate 1 in this preferred embodiment. Alternatively, another suitable conductive material such as a conductive adhesive may be filled in the through-holes.

As described above, since each land electrode includes a plurality of through-hole electrodes, even when one of the through-hole electrodes has a faulty electrical continuity, the front and rear surfaces of the base 2 are electrically connected with each other with the other through-hole electrodes.

Also, since the through-holes are arranged in approximately circular pattern, stresses in the base 2 produced when the through-holes are formed by punching are evenly decentralized, thereby reducing the probability of problems such as breaking the base 2.

Figure 2:
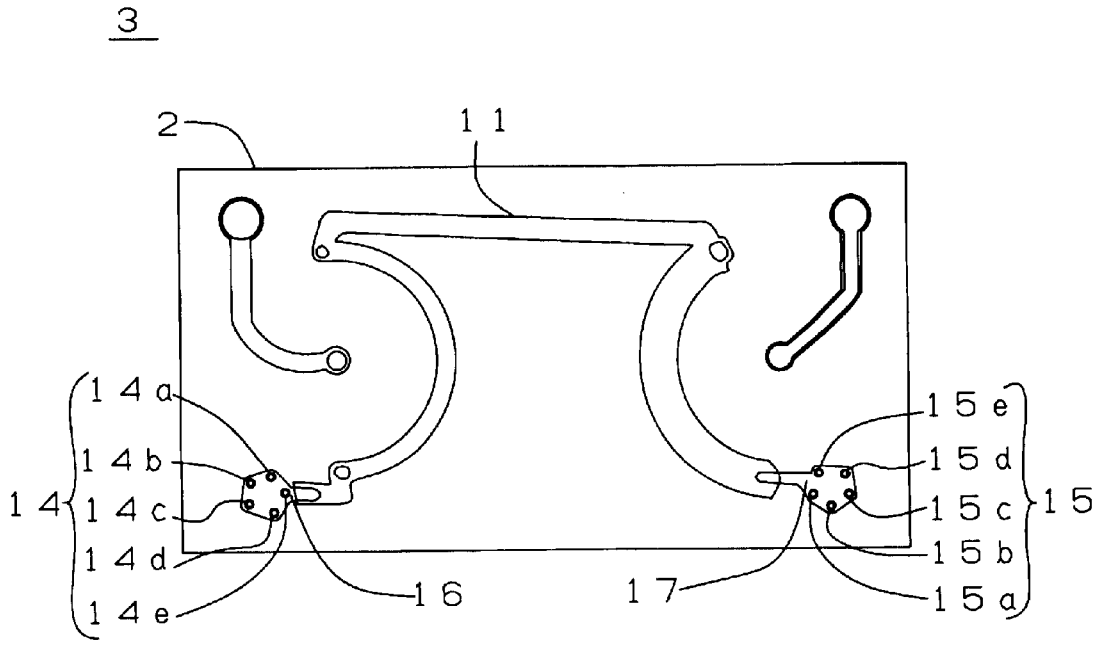
FIG. 2 is a plan view of another high-voltage variable-resistor substrate, as a second example, used for the high-voltage variable resistor according to the first preferred embodiment of the present invention.

FIG. 2 is a plan view of another high-voltage variable-resistor substrate 3, as a second example, used for the high-voltage variable resistor 30 according to the first preferred embodiment of the present invention. Like elements in FIG. 2 are identified by the same reference numerals as in the first example, and the detailed description thereof is omitted.

As shown in FIG. 2, in the high-voltage variable-resistor substrate 3 in the second example, the shapes of land electrodes 16 and 17 having the through-holes 14 and 15, respectively, are different from those of the land electrodes 12 and 13 in the first example.

That is, the land electrodes 16 and 17 are configured so as to have approximately pentagonal shapes in correspondence with the outer peripheries defined by the through-holes 14 (14*a*, 14*b*, 14*c*, 14*d*, 14*e*) and the through-holes 15 (15*a*, 15*b*, 15*c*, 15*d*, 15*e*), respectively.

Also, two land electrodes having the same shapes as those of the land electrodes 16 and 17 are provided on the rear surface of the high-voltage variable-resistor substrate 3 so as to correspond to the foregoing land electrodes 16 and 17, respectively.

With this arrangement, since portions of the land electrodes 16 and 17, surrounded by corresponding through-holes, have substantially the same shape, when the through-holes 14 and 15 are filled with a conductor such as a conductive paste, the conductor is filled evenly in all the through-holes.

Although each of the land electrodes 16 and 17 is approximately pentagonal because of having 5 through-holes in this example, when each of the land electrodes 16 and 17 has, for example, 7 through-holes, the land electrode becomes approximately heptagonal.

Figure 3:
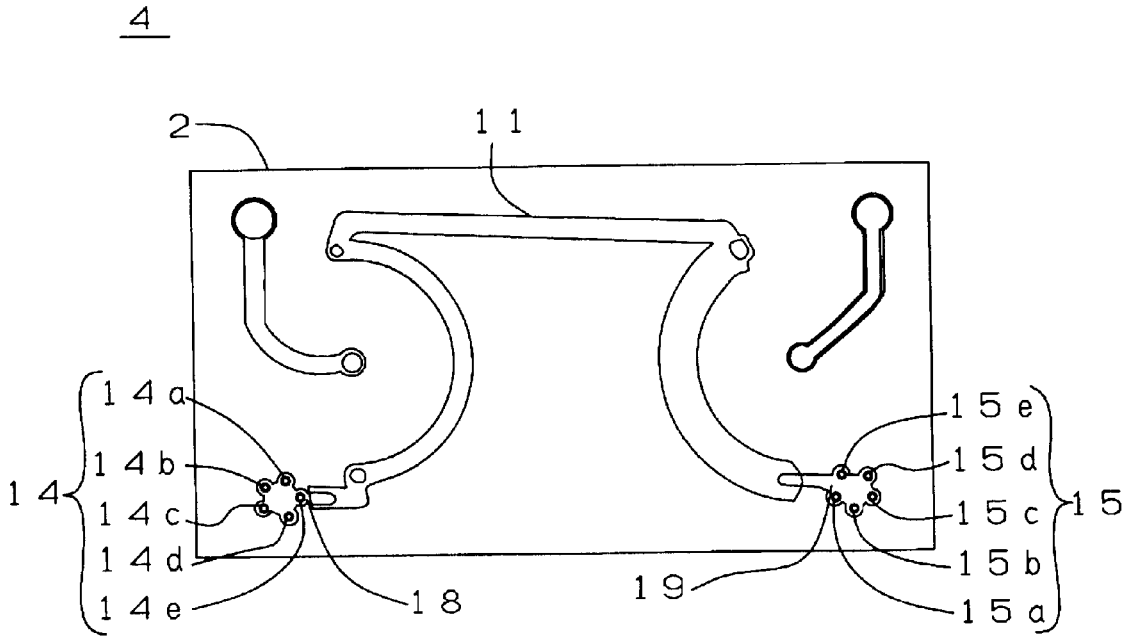
FIG. 3 is a plan view of another high-voltage variable-resistor substrate, as a third example, used for the high-voltage variable resistor according to the first preferred embodiment of the present invention.

FIG. 3 is a plan view of another high-voltage variable-resistor substrate 4, as a third example, used for the high-voltage variable resistor 30 according to the first preferred embodiment of the present invention. Like elements in FIG. 3 are identified by the same reference numerals in the first example, and the detailed description thereof is omitted.

As shown in FIG. 3, in the high-voltage variable-resistor substrate 4 in the third example, the shapes of land electrodes 18 and 19 having the through-holes 14 and 15, respectively, are different from those of the land electrodes 12 and 13 in the first example and from those of the land electrodes 16 and 17 in the second example. That is, the land electrodes 18 and 19 have pentalobal shapes, as shown in FIG. 3, in correspondence with the outer peripheries defined by the through-holes 14 (14*a*, 14*b*, 14*c*, 14*d*, 14*e*) and the through-holes 15 (15*a*, 15*b*, 15*c*, 15*d*, 15*e*), respectively.

Also, two land electrodes having the same shapes as those of the land electrodes 18 and 19 are provided on the rear surface of the high-voltage variable-resistor substrate 4 so as to correspond to the foregoing land electrodes 18 and 19, respectively.

With this arrangement, since portions of the land electrodes 18 and 19 surrounded by corresponding through-holes, have substantially the same shape, when the through-holes 14 and 15 are filled with a conductor such as a conductive paste, the conductor is filled evenly in all the through-holes.

Figure 4A:
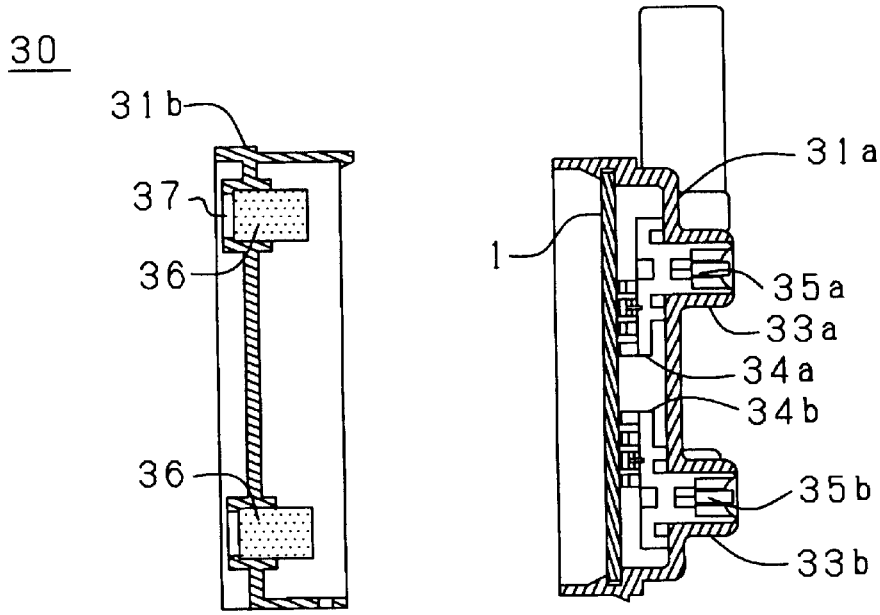
FIGS. 4A and 4B are an exploded side sectional view and a side sectional view, respectively, of the high-voltage variable resistor according to the first preferred embodiment of the present invention.
Figure 4B:
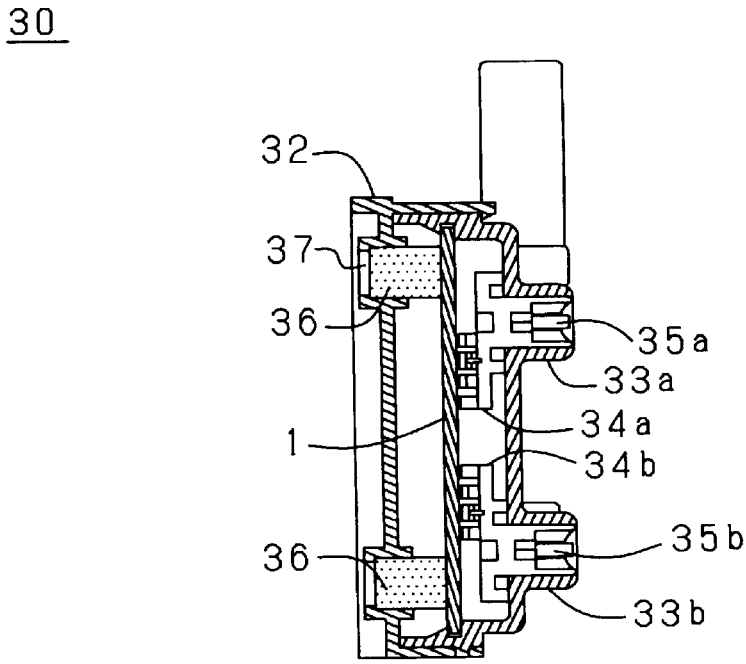
Figure 5:
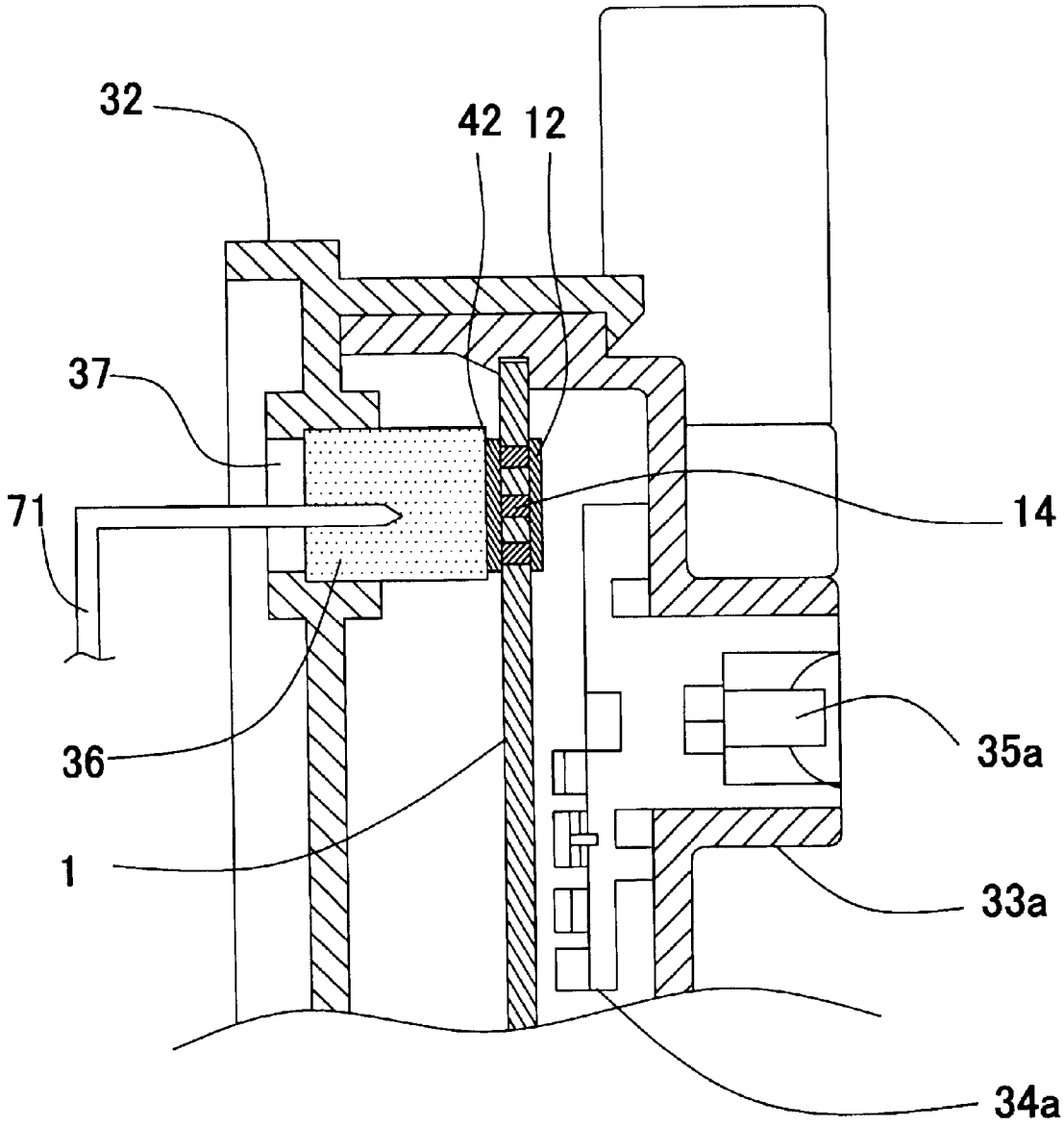
FIG. 5 is an enlarged side sectional view of the upper part of the high-voltage variable resistor shown in FIG. 4B.
Figure 6:
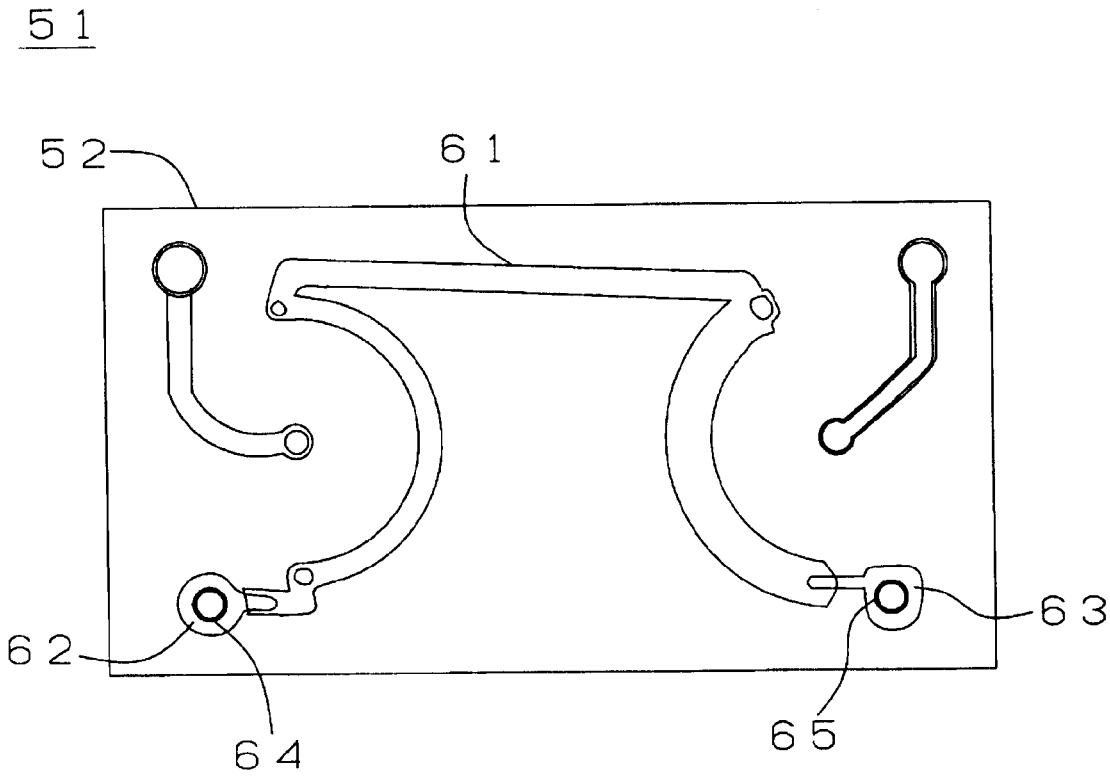
Fig.6 PRIOR ART
FIG. 6 is a plan view of a high-voltage variable-resistor substrate used for a known high-voltage variable resistor.
Figure 7A:
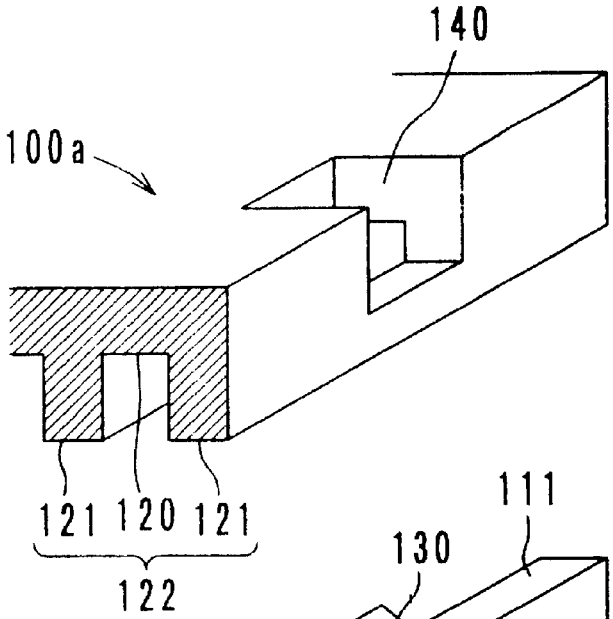
Fig.7A PRIOR ART
FIGS. 7A to 7C are perspective views of side walls of an insulating case of the known high-voltage variable resistor.
Figure 7B:
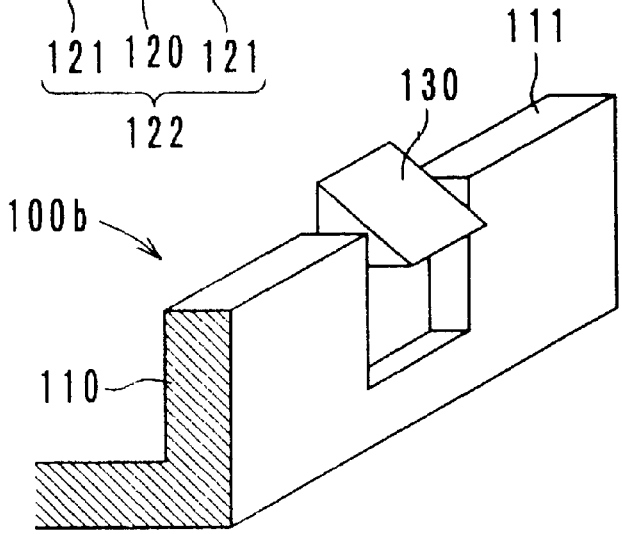
Fig.7B PRIOR ART
Figure 7C:
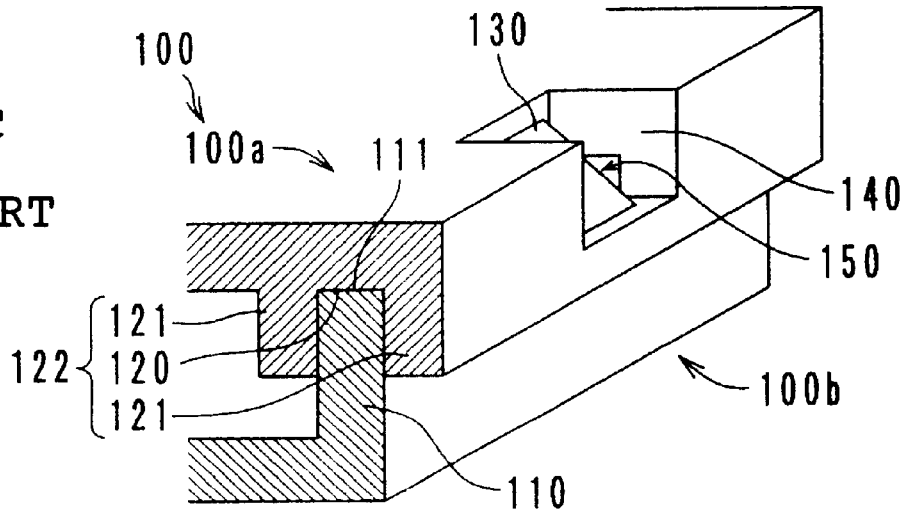
Fig. 7C PRIOR ART

Referring now to FIGS. 4A, 4B, and 5, the high-voltage variable resistor 30 according to the first preferred embodiment of the present invention will be described. FIGS. 4A and 4B are an exploded side sectional view and a side sectional view, respectively, of the high-voltage variable resistor 30 according to the first preferred embodiment. FIG. 5 is an enlarged side sectional view of the upper portion of the high-voltage variable resistor 30 shown in FIG. 4B.

As shown in FIGS. 4A and 4B, the high-voltage variable-resistor substrate 1 in this preferred embodiment is housed in an insulating case 32 defined by two cases, that is, preferably substantially rectangular front and rear cases 31*a* and 31*b*. The insulating case 32 is formed by engaging the front and rear cases 31*a* and 31*b* with each other. Since, for example, an engaging projection is fitted into an engaging groove disposed in correspondence to the engaging projection (both not being shown) by elastically locking or engaging with each other, the front and rear cases 31*a* and 31*b* almost completely cover the inside of the insulating case 32.

As shown in FIGS. 4A and 4B, the front case 31*a* preferably has substantially cylindrical bearings 33*a* and 33*b* which are provided on the front surface thereof and which rotatably support rotating shafts 35*a* and 35*b* having sliders 34*a* and 34*b*, respectively.

Also, as shown in FIGS. 4A and 4B, in the insulating case 32, the high-voltage variable-resistor substrate 1 in the first example shown in FIGS. 1A and 1B is housed such that its front surface opposes the front case 31*a*. The sliders 34*a* and 34*b* are arranged such that one end of each slider slides on the resistor element 11 of the high-voltage variable-resistor substrate 1 shown in FIG. 1.

In addition, as shown in FIGS. 4A and 4B, the rear case 31*b* includes conductive rubbers 36 provided on the bottom thereof. The conductive rubbers 36 are provided on the bottom of the rear case 31*b* and are fixed by inserting one end of each conductive rubber 36 into a receiving portion of a corresponding external connecting hole 37 which extends through the rear case 31*b*. Also, as shown in FIG. 5, one of the conductive rubbers 36 is arranged so as to correspond to the land electrode 42 on the rear surface of the high-voltage variable-resistor substrate 1, and one end of the conductive rubber 36 contacts the land electrode 42 on the foregoing rear surface so as to push the high-voltage variable-resistor substrate 1 from the rear case 31*b* side. In addition, external terminals such as input terminals and ground terminals are fitted into the conductive rubbers 36 through the external connecting holes 37 from the outside.

With this arrangement, as shown in FIG. 5, input terminals 71 pass through the corresponding external connecting hole 37 and are fitted into the conductive rubber 36 such that the land electrode 12 on the front surface of the high-voltage variable-resistor substrate 1 and the input terminals 71 are electrically connected via the through-hole electrodes defined by the through-holes 14, the land electrode 42, and the corresponding conductive rubber 36. Also, although not shown in FIG. 5, the land electrode 13 on the front surface of the high-voltage variable-resistor substrate 1 shown in FIG. 1A is electrically connected to ground terminals in the same manner as described above.

Although the high-voltage variable-resistor substrate 1 in the first example is used for the high-voltage variable-resistor substrate 30 according to the this preferred embodiment, those skilled in the art will appreciate that the high-voltage variable-resistor substrate 3 in the second example or the high-voltage variable-resistor substrate 4 in the third example may be used instead of the high-voltage variable-resistor substrate 1.

Also, although the conductive rubbers 36 are used in this preferred embodiment, another conductor may be used.

Furthermore, although the above description has been directed to the high-voltage variable resistor which outputs one focus voltage and one screen voltage, the present invention is not limited to this application. The present invention is also applicable to, for example, a so-called double-focus-type high-voltage variable resistor which outputs two focus voltages.

Figure 8:
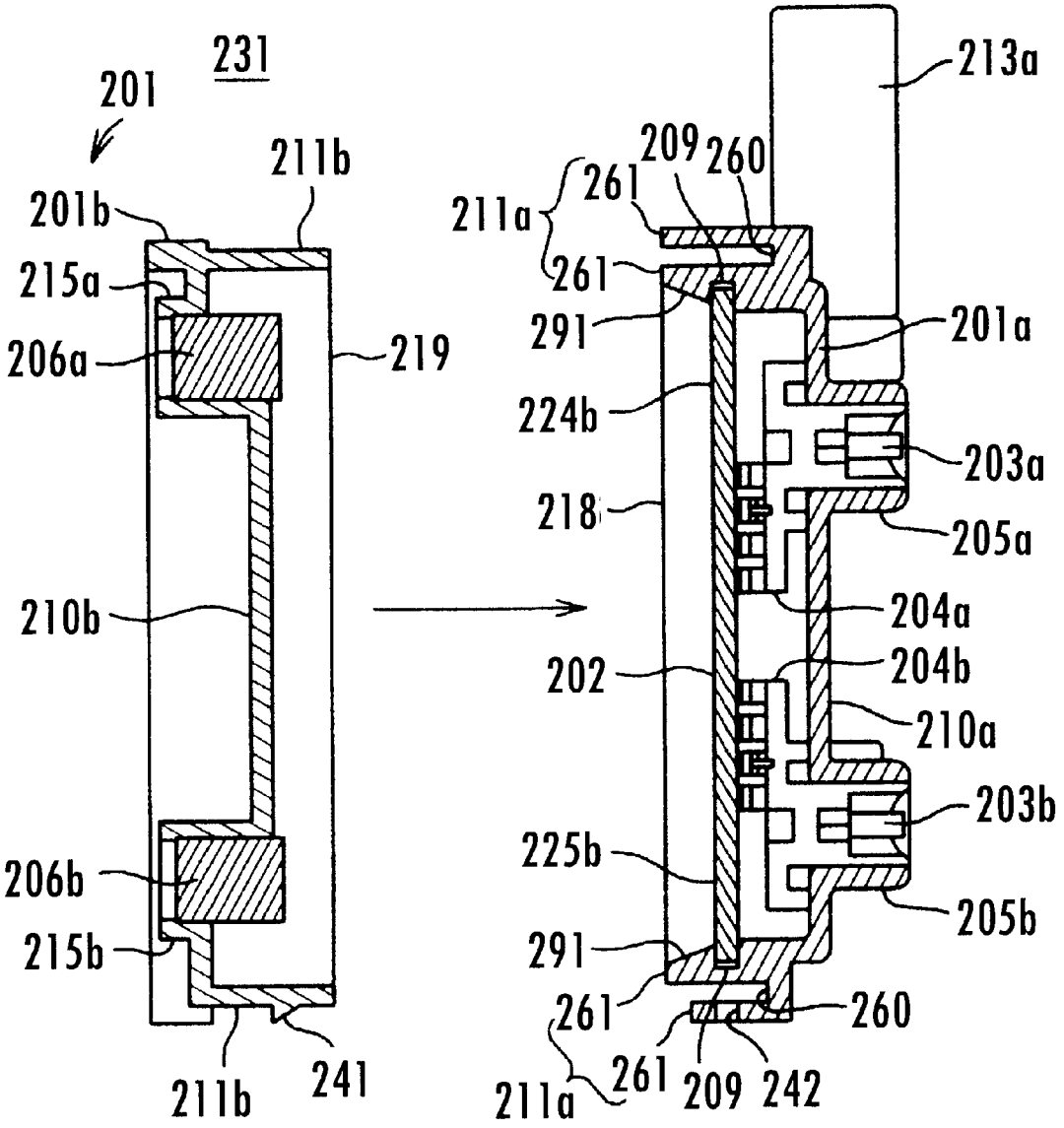
FIG. 8 is an exploded vertical sectional view of a high-voltage variable resistor according to a second preferred embodiment of the present invention.
Figure 9:
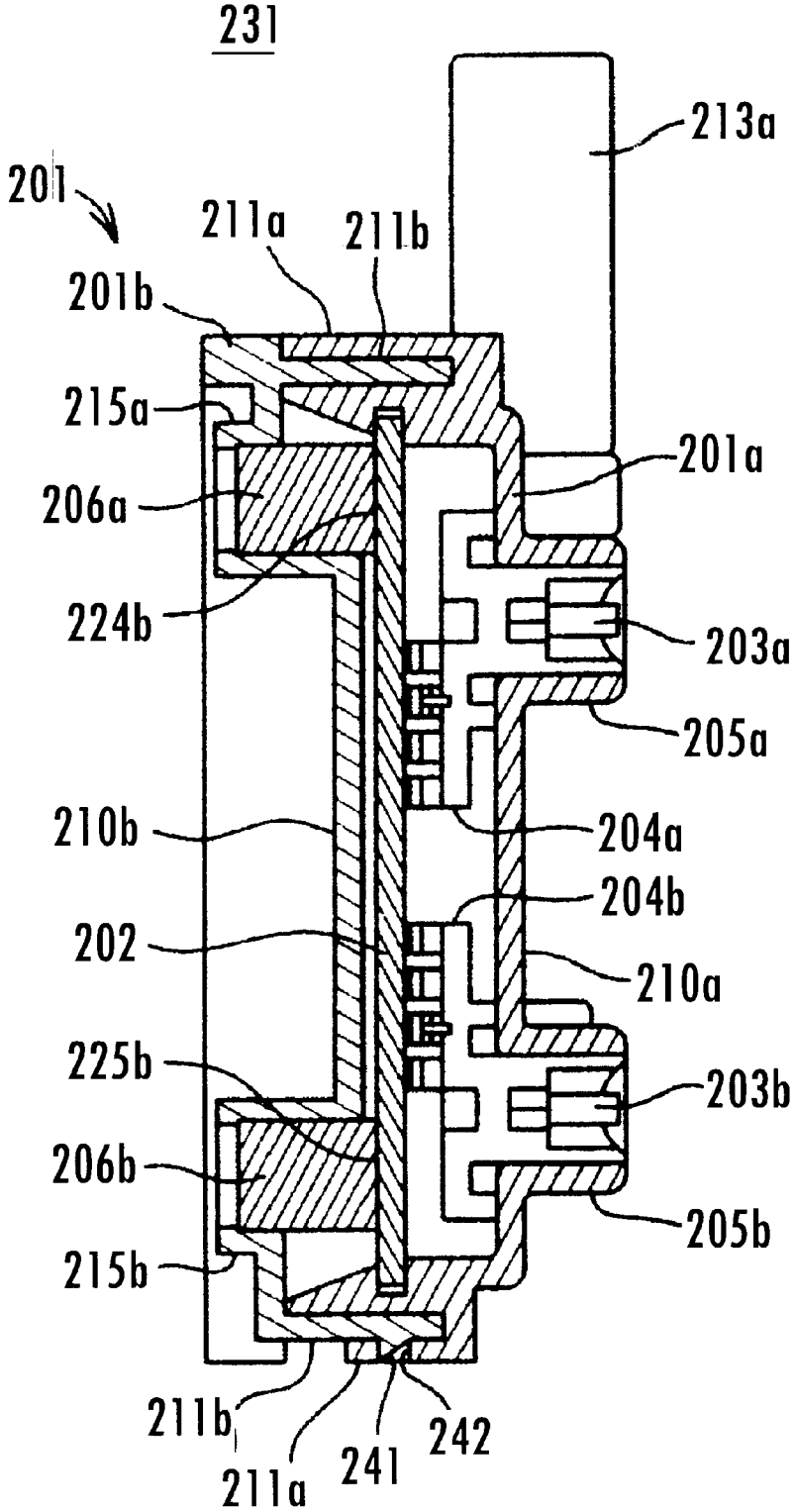
FIG. 9 is a vertical sectional view of the high-voltage variable resistor shown in FIG. 8.

Referring now to FIGS. 8 to 13, a high-voltage variable resistor according to a second preferred embodiment of the present invention will be described. FIG. 8 is an exploded vertical sectional view of a high-voltage variable resistor 231, and FIG. 9 is a vertical sectional view of the completely assembled high-voltage variable resistor 231. The high-voltage variable resistor 231 includes an insulating case 201 defined by combining a front case 201*a* and a rear case 201*b*, an insulating substrate 202, rotating shafts 203*a* and 203*b*, and conductive rubbers 206*a* and 206*b*. The front case 201*a* and the rear case 201*b* are preferably resin molded components but can be made of other suitable material.

Figure 10:
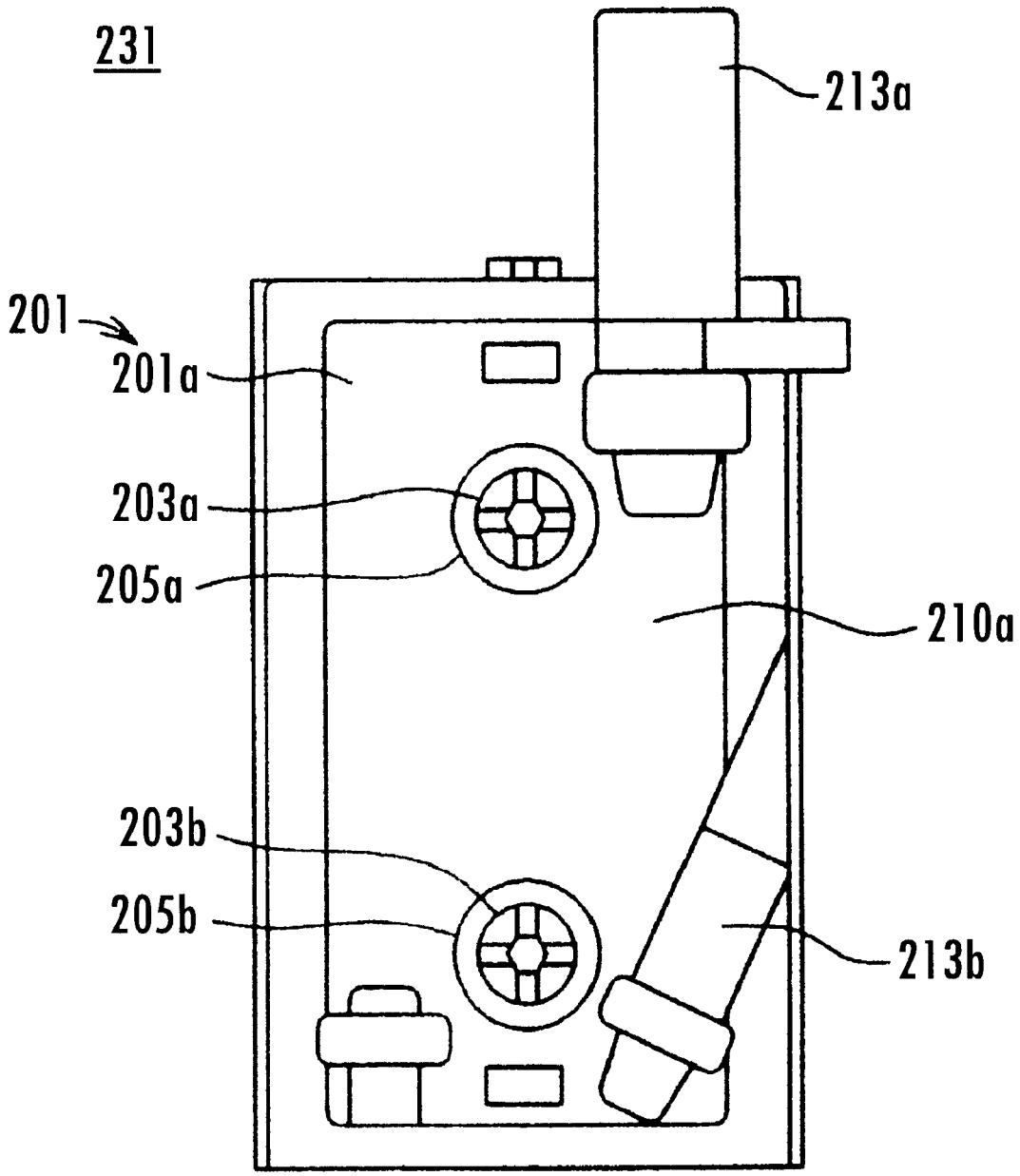
FIG. 10 is a front view of the high-voltage variable resistor shown in FIG. 8.

The front case 201*a* has a plate-like portion 210*a* which has, for example, a substantially rectangular flat shape, as shown in FIG. 10, side walls 21 la provided along the peripheral sides of the plate-like portion 210*a*, bearings 205*a* and 205*b* provided on the plate-like portion 210*a*, and an opening end 218 formed by the side walls 211*a*. Each side wall 211*a* has two flat plate members 261 and a fitting depression 260 provided between the two flat plate members 261 in this preferred embodiment. The side wall 211*a* includes an engaging groove 242 in the outside one of the flat plate members 261 so as to extend therethrough.

Figure 11:
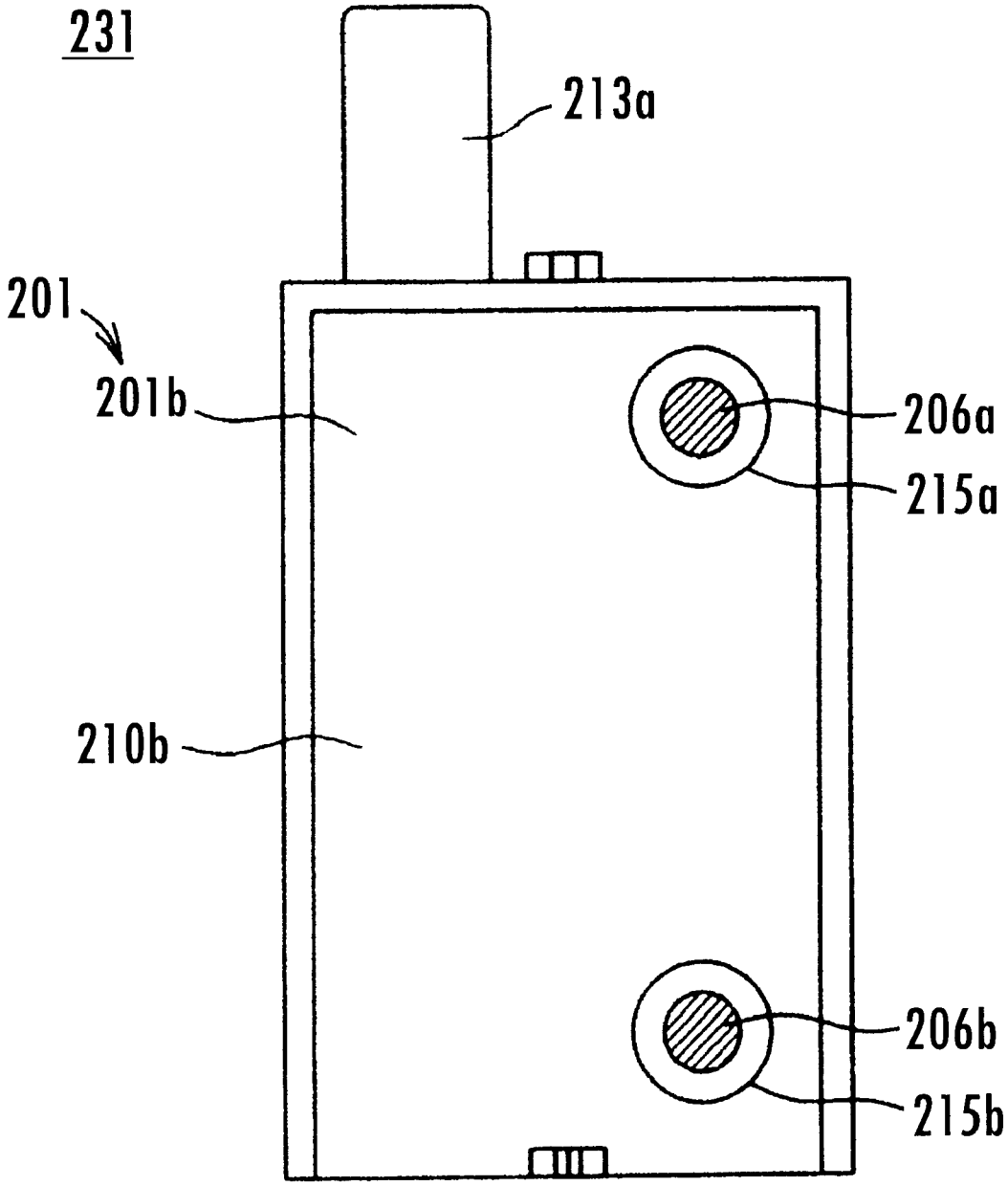
FIG. 11 is a rear view of the high-voltage variable resistor shown in FIG. 8.

The rear case 201*b* includes a plate-like portion 210*b* which has a substantially rectangular flat shape, as shown in FIG. 11, side walls 211*b* provided along the peripheral sides of the plate-like portion 210*b*, substantially cylindrical holders 215*a* and 215*b* provided on the plate-like portion 210*b*, and an opening end 219 defined by the side walls 211*b*. Each side wall 211*b* is made from a single flat plate member in this preferred embodiment. The front of the side wall 211*b* is fitted into the fitting depression 260 of the front case 201*a*. Also, the side wall 211*b* includes an engaging projection 241 provided on the outer wall thereof such that the engaging projection 241 elastically engages the engaging groove 242 of the front case 201*a*. The engaging projection 241 has a pawl shape having, for example, a right-angled triangular cross section.

By inserting the fronts of the side walls 21 1*b* of the rear case 201*b* into the fitting depressions 260 of the front case 201*a* and by elastically engaging the engaging projection 241 with the engaging groove 242, the front case 201*a* and the rear case 201*b* completely cover the inside of the insulating case 201 and are securely engaged with each other so as not to be easily detached.

The engaging projection 241 and the engaging groove 242 may be disposed at any location of the side walls 211*b* and 211*a* except for at the opening ends 219 and 218, respectively, since a gap in communication with the inside the insulating case is produced in a similar fashion to that in the known high-voltage variable resistor if the engaging projection 241 and the engaging groove 242 are disposed in the opening ends 218 and 219, respectively.

The positions, the numbers, and the shapes of the engaging projection 241 and the engaging groove 242 are not limited to this preferred embodiment, but any configuration is acceptable as long as the front case 201*a* and the rear case 201*b* are securely engaged with each other. Also, instead of the engaging groove 242, an engaging depression which does not extend through the side wall or an engaging step for locking the engaging projection 241 may be disposed.

In the above description, although each of the side walls 211*a* of the front case 201*a* is defined by two flat plate members by way of example, it may be defined by a single flat plate member or by three or more flat members as long as the front case 201*a* and the rear case 201*b* are securely engaged with each other. Also, although each of the side walls 211*b* of the rear case 201*b* is defined by a single flat plate member by way of example, it may be defined by a plurality of flat plate members.

In addition, in this preferred embodiment, each of the engaging projection 241 and the engaging groove 242 is provided on only one surface of the corresponding side wall by way of example. Alternatively, a plurality of the engaging projections 241 and the engaging grooves 242 (or either of engaging depressions and engaging steps) may be provided on a plurality of surfaces of the corresponding side walls. Furthermore, a plurality of each of the engaging projections 241 and the engaging grooves 242 (or either of engaging depressions and engaging steps) may be provided on one surface of the corresponding side wall.

The two mutually opposing side walls 211*a* of the front case 201*a* include depressions 209 on the inner walls thereof, each having a width substantially the same as the thickness of the insulating substrate 202. The insulating substrate 202 is fitted into these depressions 209 at the two edges thereof, and thus, is held and fixed in the insulating case 201. The side walls 211*a* have pawls 291, each provided at the rear portion of the inner one of the two flat plate members 261 and extending from the corresponding depression 209 toward the opening end 218. The sectional shape of each pawl 291 is, for example, a right-angled triangle whose oblique line lies at the opening end 218 such that the insulating substrate 202 is easily fitted into the depressions 209.

Although the pawl 291 has a right-angled triangular sectional shape in this preferred embodiment, it may have another sectional shape such as a substantially rectangular shape. Also, instead of the depressions 209 provided in the front case 201*a*, they may be provided in the rear case 201*b* so as to hold the insulating substrate 202 in the rear case 201*b*.

As shown in FIGS. 9 and 10, the substantially cylindrical bearings 205*a* and 205*b* provided on the front case 201*a* rotatably support the rotating shafts 203*a* and 203*b* having sliders 204*a* and 204*b*, respectively.

Figure 12:
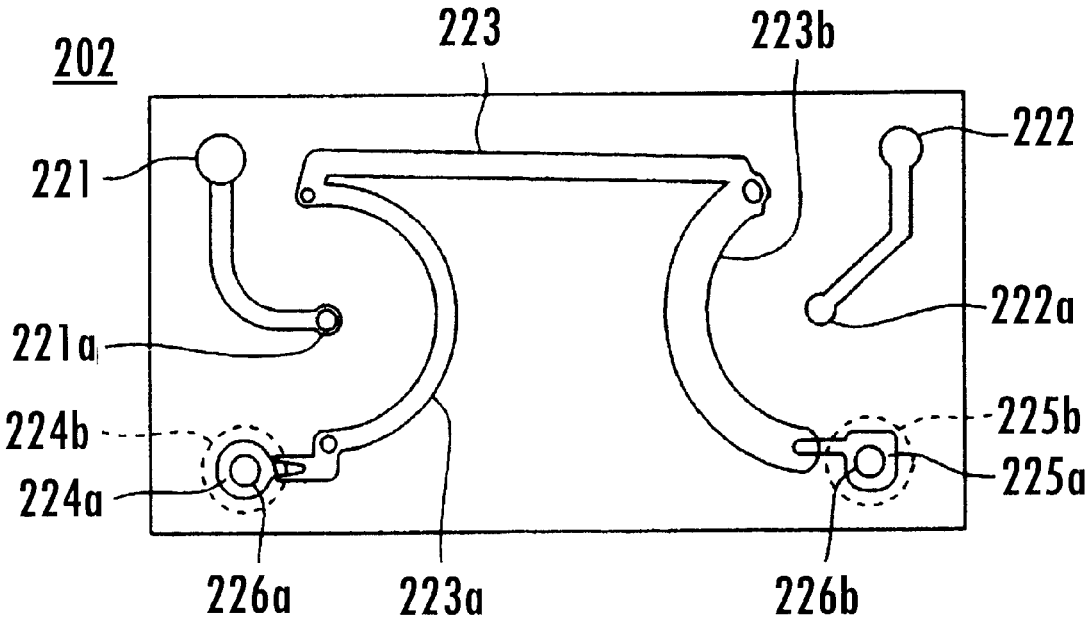
FIG. 12 is a plan view of an insulating substrate used for the high-voltage variable resistor shown in FIG. 8.

As shown in FIG. 12, the insulating substrate 202 preferably made of an alumina ceramic or other suitable material has, on the front surface thereof, an output-terminal electrode 221 used for a focus voltage, an output-terminal electrode 222 used for a screen voltage, a resistor element 223 having a variable-resistor portion 223*a* for regulating the focus voltage and a variable-resistor portion 223*b* for regulating the screen voltage, an input-terminal electrode 224*a*, and an ground-terminal electrode 225*a*, both being electrically connected to resistor element 223. Ends of the sliders 204*a* and 204*b* contact center electrodes 221*a* and 222*a* electrically connected to the output-terminal electrodes 221 and 222, respectively, and the other ends thereof are arranged so as to slide on the arc-shaped variable-resistor portions 223*a* and 223*b*, respectively. With this configuration, by pressing the tip of a screw driver into each of the crossed grooves of the rotating shafts 203*a* and 203*b* and by turning each of the rotating shafts 203*a* and 203*b*, a desired resistance of the high-voltage variable resistor 231 is set.

The insulating substrate 202 includes an input-terminal contacting electrode 224*b* and a ground-terminal contacting electrode 225*b* on the rear surface thereof, electrically connected with the input-terminal electrode 224*a* and the ground-terminal electrode 225*a* via through-hole electrodes defined by a through-hole 226*a* and a through-hole 226*b*, respectively, both being filled with, for example, a paste conductor.

As shown in FIG. 9, ends of the conductive rubbers 206*a* and 206*b* contact the input-terminal contacting electrode 224*b* and the ground-terminal contacting electrode 225*b* so as to press the corresponding electrodes, and the other ends thereof are held by the substantially cylindrical holders 215*a* and 215*b* of the rear case 201*b*, respectively. By inserting external input terminals and ground terminals into the conductive rubbers 206*a* and 206*b*, respectively, the front surface of the insulating substrate 202 is electrically connected to an external circuit.

Although the conductive rubbers 206*a* and 206*b* are used in this preferred embodiment, another conductor may be used. Also, one electrode on one side of the insulating substrate 202 includes either one of the through-hole 226*a* and the through-hole 226*b* in this preferred embodiment. Alternatively, it may have a plurality of through-holes. If one electrode includes a plurality of through-hole electrodes, even when one of the through-hole electrodes has a faulty electrical continuity, the front and rear surfaces of the insulating substrate 202 are electrically connected with each other by the other through-hole electrodes, thereby leading to an increased reliability of electrical continuity. The method for electrically connect the front and rear surfaces of the insulating substrate 202 is not limited to filling a paste conductor in the through-holes, but a conductive adhesive, rivet-like metal pieces, clip-like metal pieces, or the like may be used.

Figure 13:
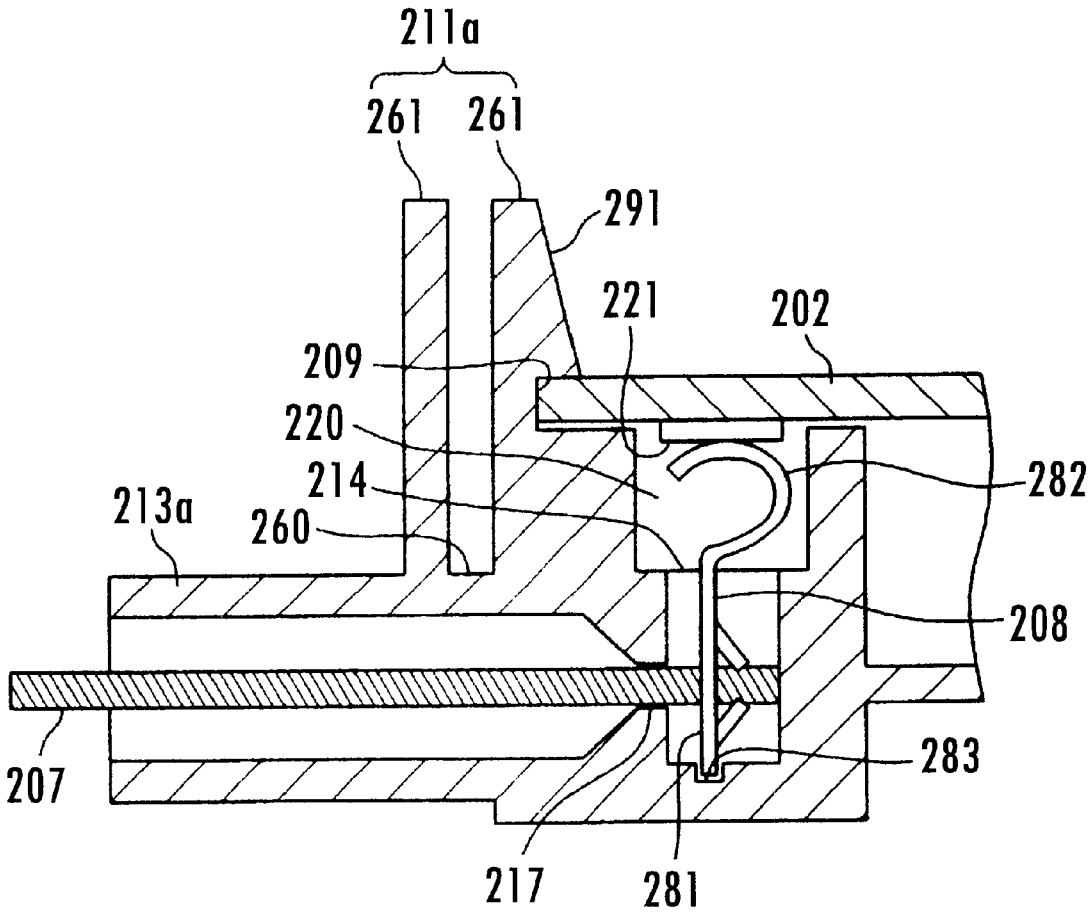
FIG. 13 is a vertical sectional view of a lead-wire holder used for carrying a focus voltage.

As shown in FIG. 10, the insulating case 201 includes a lead-wire holder 213*a* and a lead-wire holder 213*b* for holding corresponding inserted output lead wires carrying a focus voltage and a screen voltage, respectively. As shown in FIG. 13, the front case 201*a* includes a terminal fitting portion 214 therein. The terminal fitting portion 214 is in communication with the lead-wire holder 213*a* via a communication hole 217.

The terminal fitting portion 214 includes a lead-wire connecting member 208 housed therein and held thereby. The terminal fitting portion 214 includes a groove 283, engaging with both sides and the bottom of the bottom portion of a clamp portion 281 of the lead-wire connecting member 208, and a container 220 which has, for example, a cylindrical shape and which accommodates a spring portion 282 of the lead-wire connecting member 208. By inserting the bottom portion of the lead-wire connecting member 208 into the groove 283, the lead-wire connecting member 208 is prevented from falling down. When the lead-wire connecting member 208 reaches the deepest point of the groove 283, the clamp portion 281 of the lead-wire connecting member 208 corresponds to the communication hole 217. Accordingly, in a state in which the lead-wire connecting member 208 extends in the terminal fitting portion 214, when an output lead-wire 207 is inserted into the lead-wire holder 213*a* from the left side in FIG. 13, a core wire of the output lead-wire 207 is automatically press-fitted into the clamp portion 281 of the lead-wire connecting member 208.

The lead-wire connecting member 208 is made by punching a flat metal plate so as to form an approximately rectangular shape, and has the clamp portion 281, at the central portion thereof, having a plurality of catches formed inwardly so as to clamp the core wire of the output lead-wire 207. When the output lead-wire 207 is inserted into the lead-wire holder 213*a*, the core wire of the output lead-wire 207 is press-fitted into the clamp portion 281 of the lead-wire connecting member 208. When the core wire of the output lead-wire 207 is press-fitted, the catches are deformed in the press-fitting direction and are firmly attached to the core wire. Thus, the lead-wire connecting member 208 is electrically connected to the core wire and also is reliably held so as not to be detached. The catches of the clamp portion 281 may be previously formed at a slightly slanted angle in the press-fitting direction. The spring portion 282 of the lead-wire connecting member 208 contacts the output-terminal electrodes 221 and 222 on the front surface of the insulating substrate 202 with a reasonable level of pressing force such that the insulating substrate 202 is electrically connected to the output lead-wire 207.

The structure of the insulating case in the vicinity of the lead-wire holder 213*a* has been described with reference to FIG. 13. Since the structure of the insulating case in the vicinity of the lead-wire holder 213*b* is substantially the same as the above-described structure, the description and the illustration thereof are omitted.

The high-voltage variable resistor according to the present invention is not limited to the foregoing preferred embodiments, but various modifications can be made within the scope of the spirit of the present invention. For example, the spring portion 282 serves to electrically connect the output lead-wire 207 with the insulating substrate 202 in the foregoing preferred embodiments. Instead of the spring portion 282, a conductor such as a coil spring or a conductive rubber may be provided.

Also, the high-voltage variable resistor outputs one focus voltage and one screen voltage in the foregoing preferred embodiments. However, the present invention is not limited to this application, but it is also applicable to, for example, a so-called a double-focus-type high-voltage variable resistor which outputs two focus voltages.

According to various preferred embodiments of the present invention, since the insulating substrate is fitted into the depressions provided on the inner surfaces of the side walls of the insulating case so as to be held by the insulating case, and also the input-terminal and ground-terminal contacting electrodes provided on the rear surface of the insulating substrate are electrically connected to the terminal electrodes formed on the front surface of the insulating substrate via the through-hole electrodes, no slit is required in the insulating substrate and also the input terminals and the ground terminals are electrically connected to corresponding points on the front surface of the insulating substrate. Thus, a manufacturing step of fitting the conductors into the slits is eliminated, and the durability of the insulating substrate is greatly improved, thereby preventing the insulating substrate from being broken due to cracking or chipping.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A high-voltage variable resistor comprising:

an insulating case including first and second insulating cases; and a high-voltage variable-resistor substrate including a base having a resistor element on a front surface thereof, a plurality of through-hole electrodes provided so as to extend through the base, and at least one land electrode provided on each of the front surface and a rear surface of the base and connected to the through-hole electrodes; wherein the plurality of the through-hole electrodes are provided at said at least one land electrode of the high-voltage variable-resistor substrate;

the high-voltage variable-resistor substrate is housed in the insulating case;

at least one conductor is provided in the second insulating case; and the conductor and the land electrode on the rear surface of the high-voltage variable-resistor substrate are electrically connected to each other.

2. The high-voltage variable resistor according to claim 1, wherein the plurality of through-hole electrodes provided at said at least one land electrode is arranged in an approximately circular configuration.

3. The high-voltage variable resistor according to claim 1, wherein each portion of the land electrode, surrounded by a corresponding one of the plurality of through-hole electrodes, has substantially the same shape.

4. The high-voltage variable resistor according to claim 1, further comprising:

at least one rotating shaft including a slider which slides on the resistor element; wherein the first insulating case includes a plate-like portion, sides walls provided along peripheral sides of the plate-like portion, at least one bearing which is provided in the plate-like portion and which rotatably supports the rotating shaft, an opening end defined by the side walls, and at least one first engaging member provided at a portion of the side walls;

the second insulating case includes a plate-like portion, side walls provided along peripheral sides of the plate-like portion, an opening end defined by the side walls, and at least one second engaging member disposed at a desired portion of the side walls; wherein by engaging the first engaging member of the side walls of the first insulating case with the second engaging member of the side walls of the second insulating case, the high-voltage variable-resistor substrate is housed in the insulating case, and the first and second insulating cases are engaged with each other so as not to produce a gap therebetween which gap extends inside the insulating case.

5. The high-voltage variable resistor according to claim 4, wherein the engaging member provided at the portion of the side walls of the first and second insulating cases is provided at a location other than the opening ends.

6. The high-voltage variable resistor according to claim 4, wherein one of the engaging members provided at portions of the side walls of the first and second insulating cases is an engaging projection, and the other of the engaging members is one of an engaging groove, an engaging depression, and an engaging step.

7. The high-voltage variable resistor according to claim 6, wherein one of each side wall of the first insulating case and each side wall of the second insulating case includes at least one flat plate member, and the other includes a plurality of flat plate members and includes at least one depression between the plurality of flat plate members; wherein the side wall defined by said at least one flat plate member is disposed in the depression between the plurality of flat plate members;

the engaging members include the engaging projection, disposed at the side wall defined by said at least one flat plate member, and one of the engaging groove, the engaging depression, and the engaging step provided at the outermost plate member of the side wall defined by the plurality of flat plate members; and the engaging projection is engaged with one of the engaging groove, the engaging depression, and the engaging step.

8. The high-voltage variable resistor according to claim 4, wherein one of the side walls of the first and second insulating cases includes depressions on the inner walls thereof, and the high-voltage variable-resistor substrate is held and fixed in the insulating case by inserting the substrate into the depressions.

9. The high-voltage variable resistor according to claim 1, wherein the conductor is a conductive rubber.

10. A high-voltage variable resistor comprising:

an insulating case; and a high-voltage variable-resistor substrate including a base having a resistor element on a front surface thereof, a plurality of through-hole electrodes arranged so as to extend through the base, and at least one land electrode provided on each of the front surface and a rear surface of the base and connected to the through-hole electrodes; wherein the plurality of the through-hole electrodes are provided at said at least one land electrode of the high-voltage variable-resistor substrate;

the high-voltage variable-resistor substrate is housed in the insulating case;

at least one conductor is provided in the insulating case; and the at least one conductor and the land electrode on the rear surface of the high-voltage variable-resistor substrate are electrically connected to each other.

11. The high-voltage variable resistor according to claim 10, wherein the insulating case includes first and second insulating case portions.

12. The high-voltage variable resistor according to claim 10, wherein the plurality of through-hole electrodes provided at said at least one land electrode is arranged in an approximately circular configuration.

13. The high-voltage variable resistor according to claim 10, wherein each portion of the land electrode, surrounded by a corresponding one of the plurality of through-hole electrodes, has substantially the same shape.

14. The high-voltage variable resistor according to claim 11, further comprising:

at least one rotating shaft including a slider which slides on the resistor element; wherein the first insulating case includes a plate-like portion, sides walls provided along peripheral sides of the plate-like portion, at least one bearing which is provided in the plate-like portion and which rotatably supports the rotating shaft, an opening end defined by the side walls, and at least one first engaging member provided at a desired portion of the side walls;

the second insulating case includes a plate-like portion, side walls provided along peripheral sides of the plate-like portion, an opening end defined by the side walls, and at least one second engaging member disposed at a portion of the side walls; wherein by engaging the first engaging member of the side walls of the first insulating case with the second engaging member of the side walls of the second insulating case, the high-voltage variable-resistor substrate is housed in the insulating case, and the first and second insulating cases are engaged with each other so as not to produce a gap therebetween which gap extends inside the insulating case.

15. The high-voltage variable resistor according to claim 14, wherein the engaging member provided at the portion of the side walls of the first and second insulating cases is provided at a location other than the opening ends.

16. The high-voltage variable resistor according to claim 14, wherein one of the engaging members provided at portions of the side walls of the first and second insulating cases is an engaging projection, and the other is one of an engaging groove, an engaging depression, and an engaging step.

17. The high-voltage variable resistor according to claim 16, wherein one of each side wall of the first insulating case and each side wall of the second insulating case includes at least one flat plate member, and the other includes a plurality of flat plate members and includes at least one depression between the plurality of flat plate members; wherein the side wall defined by said at least one flat plate member is disposed in the depression between the plurality of flat plate members;

the engaging members include the engaging projection, disposed at the side wall defined by said at least one flat plate member, and one of the engaging groove, the engaging depression, and the engaging step provided at the outermost plate member of the side wall defined by the plurality of flat plate members; and the engaging projection is engaged with one of the engaging groove, the engaging depression, and the engaging step.

18. The high-voltage variable resistor according to claim 14, wherein one of the side walls of the first and second insulating cases includes depressions on the inner walls thereof, and the high-voltage variable-resistor substrate is held and fixed in the insulating case by the substrate being disposed in the depressions.

19. The high-voltage variable resistor according to claim 10, wherein the conductor is a conductive rubber.

* * * * *